US007180455B2

(12) United States Patent
Oh et al.

(10) Patent No.: US 7,180,455 B2
(45) Date of Patent: Feb. 20, 2007

(54) BROADBAND INTERNAL ANTENNA

(75) Inventors: Sae Won Oh, Kyungki-do (KR); Chul Ho Kim, Kyungki-do (KR); Hyun Hak Kim, Kyungki-do (KR); Tae Sung Kim, Seoul (KR); Young Deg Kim, Kyungki-do (KR); Gi Tae Do, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 11/091,987

(22) Filed: Mar. 29, 2005

(65) Prior Publication Data

US 2006/0077115 A1 Apr. 13, 2006

(30) Foreign Application Priority Data

Oct. 13, 2004 (KR) ..... 10-2004-0081860

(51) Int. Cl.
*H01Q 21/00* (2006.01)
*H01Q 1/36* (2006.01)

(52) U.S. Cl. ..... 343/725; 343/702; 343/895

(58) Field of Classification Search ..... 343/725, 343/728, 895, 702
See application file for complete search history.

(56) References Cited

U.S. PATENT DOCUMENTS

| | | | | |
|---|---|---|---|---|
| 3,852,759 A | | 12/1974 | Felsenheld et al. | 343/725 |
| 5,828,342 A | * | 10/1998 | Hayes et al. | 343/702 |
| 5,923,305 A | | 7/1999 | Sadler et al. | 343/895 |
| 5,999,142 A | * | 12/1999 | Jang | 343/702 |
| 6,107,970 A | * | 8/2000 | Holshouser et al. | 343/702 |
| 6,198,440 B1 | * | 3/2001 | Ha et al. | 343/725 |
| 6,232,925 B1 | * | 5/2001 | Fujikawa | 343/895 |
| 6,448,934 B1 | * | 9/2002 | Lee et al. | 343/702 |
| 6,473,056 B2 | * | 10/2002 | Annamaa | 343/895 |
| 2002/0140622 A1 | | 10/2002 | Park et al. | 343/702 |
| 2003/0112203 A1 | | 6/2003 | Suganthan et al. | 343/895 |
| 2004/0164914 A1 | * | 8/2004 | Sue | 343/725 |

FOREIGN PATENT DOCUMENTS

| | | |
|---|---|---|
| GB | 2 391 114 | 1/2004 |
| KR | 2001-0052069 | 6/2001 |
| WO | WO 98/15028 | 4/1998 |
| WO | WO 2005/001991 | 1/2005 |

* cited by examiner

*Primary Examiner*—Hoang V. Nguyen
*Assistant Examiner*—Ephrem Alemu
(74) *Attorney, Agent, or Firm*—Volpe And Koenig, P.C.

(57) ABSTRACT

A broadband internal antenna includes a first radiator having a radiation part with one or more coils having different pitch intervals connected in series to each other, and a second radiator having at least one conductive strip line arranged parallel to a longitudinal direction of the first radiator. The antenna further includes a connection part to which an end of the at least one conductive strip line is connected, to which a first end of the first radiator is attached and in which a part for supplying current to the antenna and a part for grounding the antenna are formed, and an attachment pad to which a second end of the first radiator is attached and from which current is drawn. Current flowing through the first radiator and current flowing through the strip lines form current paths in different directions to set a certain broadband using mutual Electromagnetic (EM) coupling.

11 Claims, 18 Drawing Sheets

AZIMUTH-VERTICAL
(GSM)

ELEVATION1-HORIZONTAL
(GSM)

ELEVATION2-HORIZONTAL
(GSM)

AZIMUTH-VERTICAL
(DCS)

ELEVATION1-HORIZONTAL
(DCS)

ELEVATION2-HORIZONTAL
(DCS)

AZIMUTH-VERTICAL
(pcs)

ELEVATION1-HORIZONTAL
(pcs)

ELEVATION2-HORIZONTAL
(pcs)

BROADBAND INTERNAL ANTENNA

RELATED APPLICATION

The present application is based on, and claims priority from Korean Application Number 2004-81860, filed Oct. 13, 2004, the disclosure of which is incorporated by reference herein its entirety.

BACKGROUND OF THE INVENTION

1. Field of the Invention

The present invention relates generally to an antenna provided in a mobile communication terminal to transmit and receive radio signals and, more particularly, to a broadband internal antenna provided in a mobile communication terminal to process broadband signals.

2. Description of the Related Art

Currently, mobile communication terminals are required to provide various services as well as be miniaturized and lightweight. To meet such requirements, internal circuits and components adopted in the mobile communication terminals trend not only toward multi-functionality but also toward miniaturization. Such a trend is also applied to an antenna, which is one of the main components of a mobile communication terminal.

FIG. 1 is a view showing the construction of a general Planar Inverted-F Antenna (PIFA).

The PIFA is an antenna that can be mounted in a mobile terminal. As shown in FIG. 1, the PIFA basically includes a planar radiation part 2, a short pin 4 connected to the planar radiation part 2, a coaxial line 5 and a ground plate 9. The radiation part 2 is fed with power through the coaxial line 5, and forms impedance matching by short-circuiting the ground plate 9 using the short pin 4. The PIFA must be designed in consideration of the length L of the radiation part 2 and the height H of the antenna according to the width $W_p$ of the short pin 4 and the width W of the radiation part 2.

Such a PIFA has the directivity that not only improves Synthetic Aperture Radar (SAR) characteristics by attenuating a beam (directed to a human body) in such a way that one of all the beams (generated by current induced to the radiation part 2), which is directed to the ground, is induced again, but also enhances a beam induced to the direction of the radiation part 2. Furthermore, the PIFA acts as a rectangular microstrip antenna, with the length of the rectangular, planar radiation part 2 being reduced by half, thus implementing a low-profile structure. Furthermore, the PIFA is an internal antenna that is mounted in a terminal, so that the appearance of the terminal can be designed beautifully and the terminal has a characteristic of being invulnerable to external impact. Such a PIFA is improved in conformity with the multi-functionality trend. Of PIFAs, a multi-band antenna is used as shown in FIG. 2.

FIG. 2 is a view showing a conventional internal dual band antenna.

Referring to FIG. 2, the conventional internal dual band antenna includes a radiation part 20, a power feeding pin 25, and a ground pin 26. The radiation part 20 of the conventional internal antenna includes a high band radiation part 21 placed at the center of the radiation part 20 to process high band signals, and low band radiation parts 22 to 24 spaced apart from the high band radiation part 21 by a certain distance along the periphery of the high band radiation part 21 to process low band signals. That is, the high band radiation part 21 and the low band radiation parts 22 to 24 are connected parallel to each other. Furthermore, the power feeding pin 25 and the ground pin 26 are connected to one end of the radiation part 20.

However, the conventional internal dual band antenna is constructed in such a way that all the radiation parts are formed on a single plane, so that the size thereof is large and the unit cost thereof is high, thus deteriorating the competitive power of recent mobile communication terminals.

FIG. 3 is a view showing a conventional ceramic chip antenna.

Referring to FIG. 3, in the conventional ceramic chip antenna, conductors 34 and 36 performing radiation are formed using a chip stacking process. Although the case where the conductors 34 and 36 are formed in a spiral coil shape is shown in FIG. 3, various modifications are possible. The conductors 34 and 36 are formed of horizontal strip lines 34 printed parallel to a bottom 32, and vertical strip lines 36 formed by filling conductive paste in via holes formed to be vertical to the bottom 32.

Such a conventional ceramic chip antenna 30 can be manufactured in a small size, and has desired efficiency. However, the conventional ceramic chip antenna 30 is problematic in that it is sensitive to external factors because it has a narrow bandwidth, and it is difficult to be applied to an actual mobile terminal because the manufacturing cost thereof is high.

SUMMARY OF THE INVENTION

Accordingly, the present invention has been made keeping in mind the above problems occurring in the prior art, and an object of the present invention is to provide an antenna, which can be mounted in a mobile communication terminal, can be miniaturized, and can be easily implemented.

Another object of the present invention is to provide the internal antenna of a mobile communication terminal, which has excellent broadband characteristics.

In order to accomplish the above object, the present invention provides a broadband internal antenna, including a first radiator having a radiation part in which one or more coils having different pitch intervals are connected in series to each other; and a second radiator having at least one conductive strip line arranged parallel to the longitudinal direction of the first radiator; wherein current flowing thorough the first radiator and current flowing through the strip lines form current paths in different directions, thus setting a certain broadband using mutual Electromagnetic (EM) coupling.

Preferably, the first radiator is wound substantially in a rectangular parallelepiped shape.

Preferably, the first radiator comprises a first coil wound in a rectangular parallelepiped shape to have a certain pitch interval and a second coil having a pitch interval larger than that of the first coil; and a first pass band is set using an entire length of the first and second coils and a second pass band is set using the second coil.

Preferably, the second radiator further includes a connection part, to which the first end of the first radiator is attached, and in which a power feeding part for supplying current to the antenna and a ground part for grounding the antenna are formed.

Preferably, the first end of the first radiator is connected to a power feeding line for supplying current, and the power feeding line is attached to the power feeding part.

Preferably, the second end of the first radiator is connected to a drawing line from which current is drawn, and the drawing line is attached to the second radiator by connecting to an attachment pad that is formed on the second radiator.

Preferably, the resonant frequency and bandwidth of the antenna can be controlled by changing lengths of the strip lines.

Preferably, the broadband internal antenna further includes a casing made of a dielectric to surround the first radiator.

Preferably, the casing is made of a dielectric having a dielectric constant between 2 and 3.

Preferably, the second radiator is formed of a Printed Circuit Board (PCB), or is formed by a Low Temperature Co-fired Ceramics (LTCC) process.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
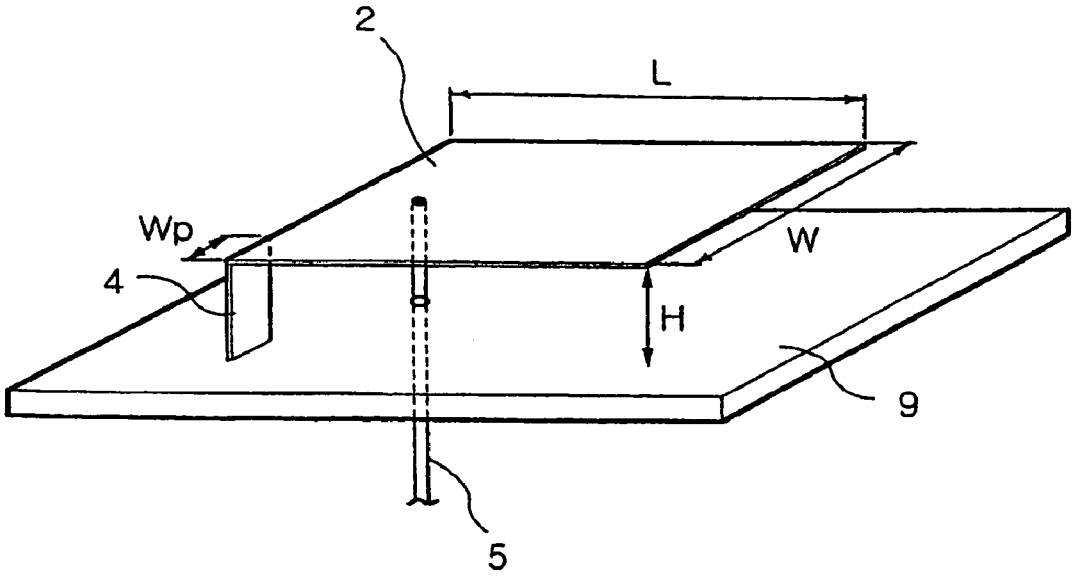
PRIOR ART FIG. 1
FIG. 1 is a view showing the construction of a general PIFA.
Figure 2:
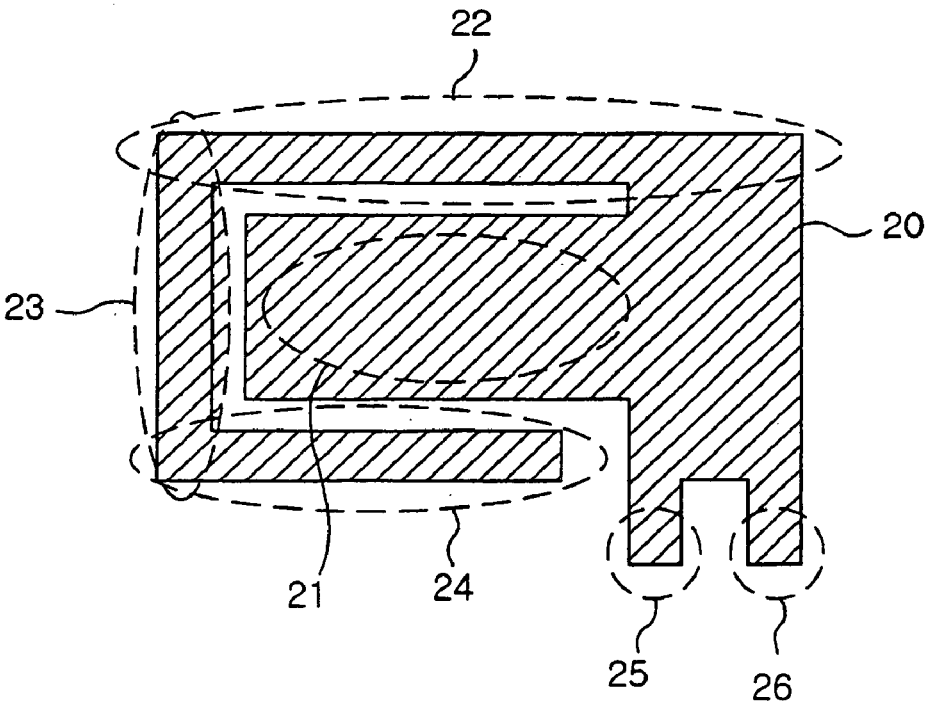
PRIOR ART FIG. 2
FIG. 2 is a view showing a conventional internal dual band antenna.
Figure 3:
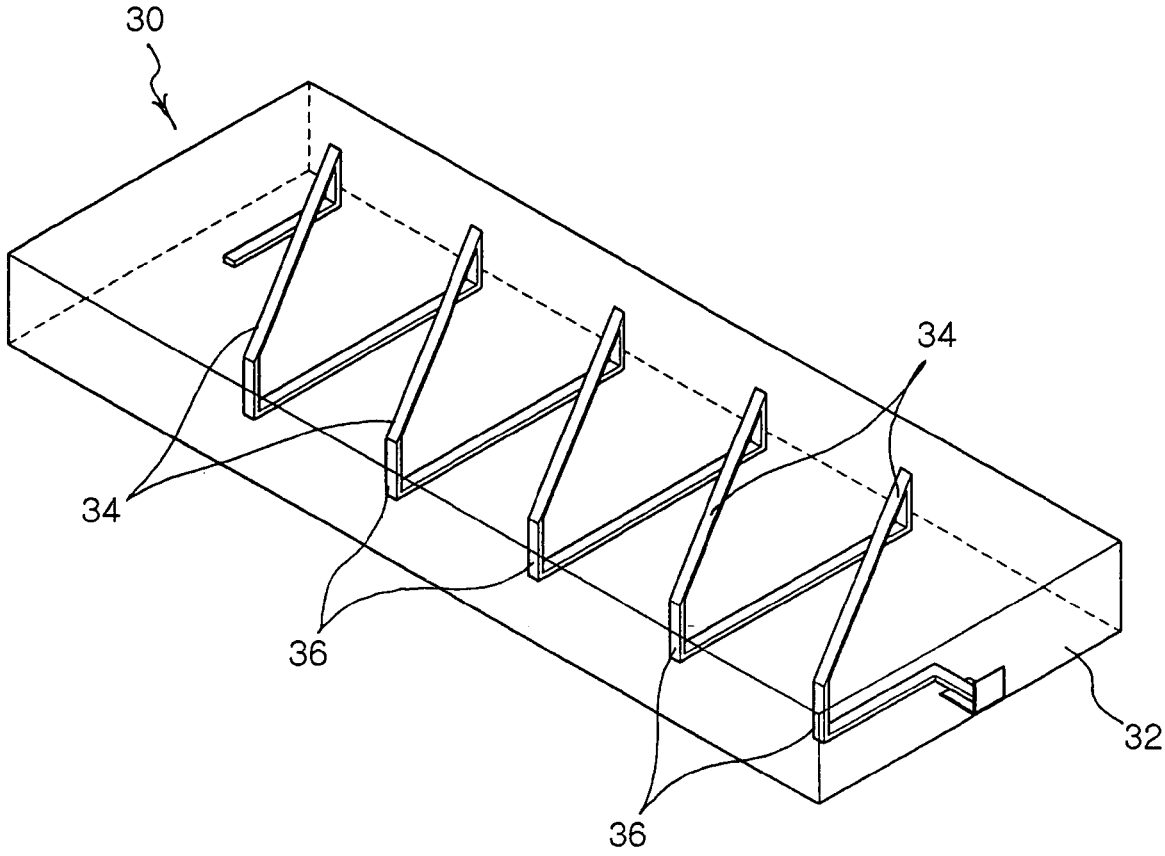
PRIOR ART FIG. 3
FIG. 3 is a view showing a conventional ceramic chip antenna.

Preferred embodiments of the present invention are described with reference to the attached drawings below. Reference now should be made to the drawings, in which the same reference numerals are used throughout the different drawings to designate the same or similar components. In the following description of the present invention, detailed descriptions may be omitted if it is determined that the detailed descriptions of related well-known functions and construction may make the gist of the present invention unclear.

Figure 4:
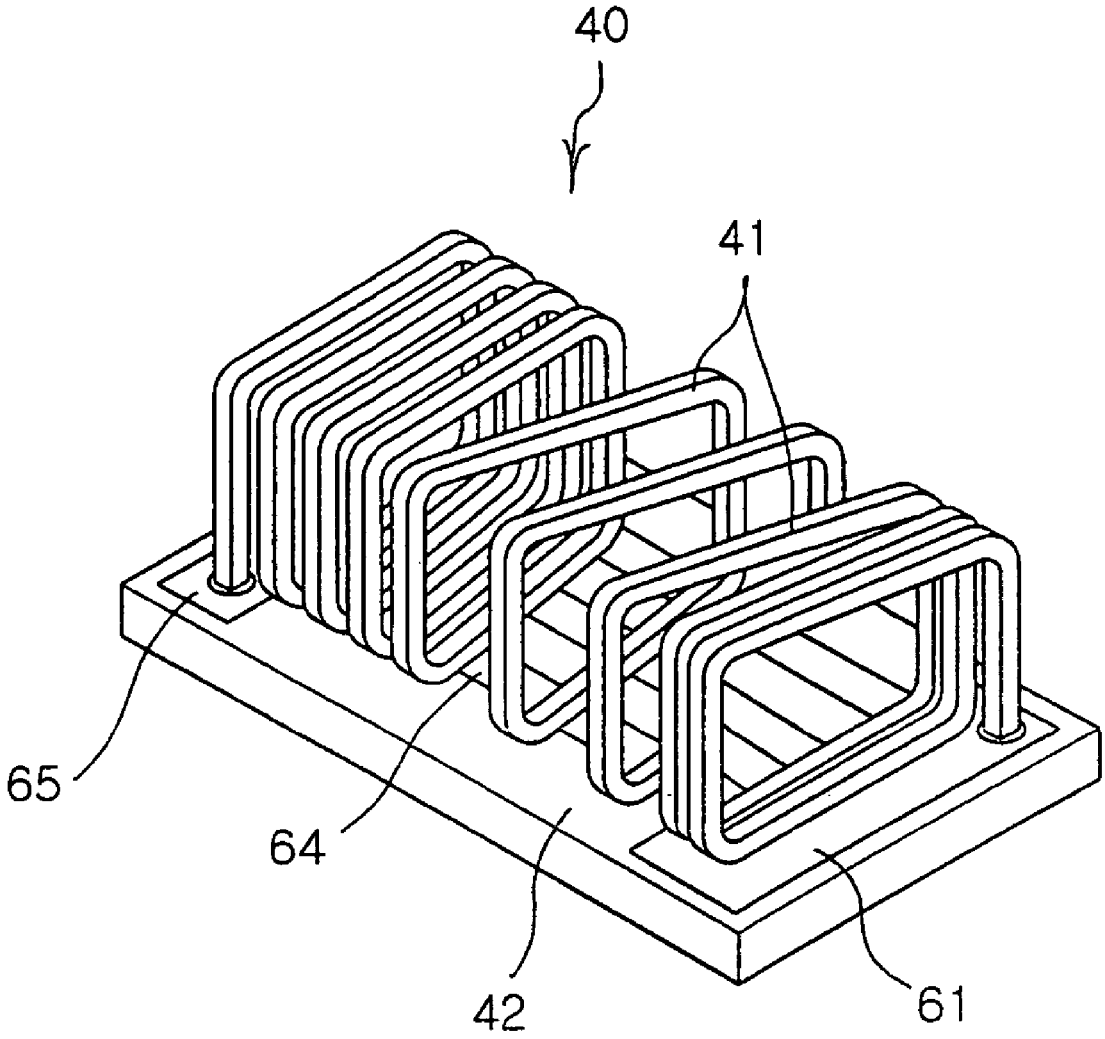
FIG. 4 is a view showing the basic construction of a broadband internal antenna according to an embodiment of the present invention.

FIG. 4 is a view showing the basic construction of a broadband internal antenna 40 according to an embodiment of the present invention.

Referring to FIG. 4, the broadband internal antenna 40 according to the embodiment of the present invention includes a first radiator 41 and a second radiator 42.

The first radiator 41 has a structure in which one or more coils having different pitch intervals are connected in series. The first radiator 41 can form multiple bands using the coils having different pitch intervals.

The second radiator 42 has one or more conductive strip lines, and is arranged parallel to the longitudinal direction of the first radiator 41. Since the first radiator 41 is wound in a spiral shape, the path of current flowing through the first radiator 41 is different in direction from that of current flowing through the strip lines of the second radiator 42 that are formed in line shapes. The antenna 40 according to the present invention is constructed so that the first and second radiators 41 and 42 having current paths in different directions can set a desired broadband using mutual Electromagnetic (EM) coupling.

Figure 5:
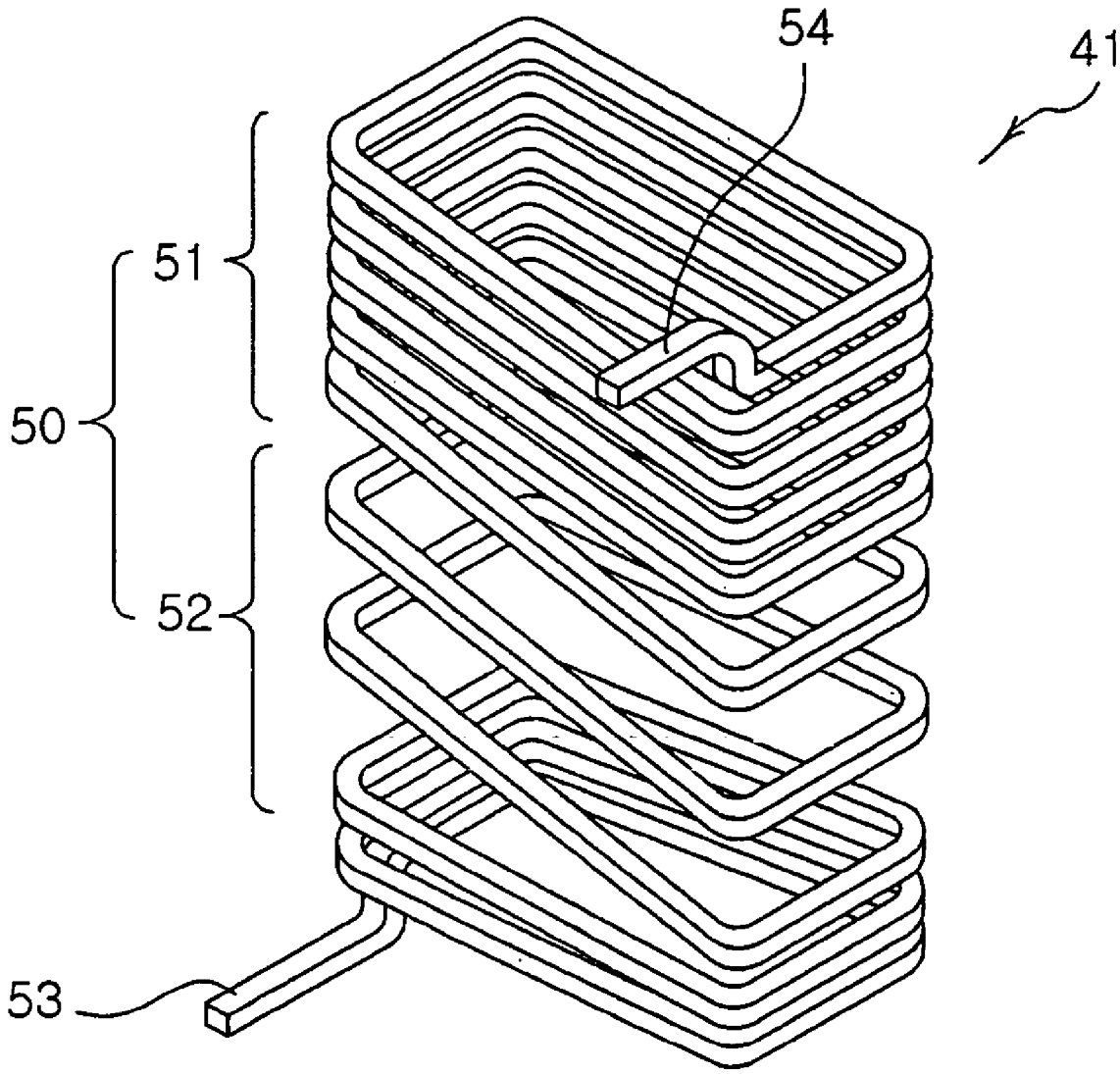
FIG. 5 is a view showing the detailed construction of a first radiator according to the embodiment of the present invention.

FIG. 5 is a view showing the detailed construction of the first radiator according to the embodiment of the present invention.

Referring to FIG. 5, the first radiator 41 according to the embodiment of the present invention includes a radiation part 50 formed of a coil wound in a rectangular shape to have one or more pitch intervals so as to radiate or receive signals in two or more set frequency bands, a power feeding line 53 connected to the radiation part 50 to be fed with electric signals, and a drawing line 54 from which electric signals are drawn.

The radiation part 50 is wound to have different pitch intervals, and formed of a first coil 51 and a second coil 52 connected to each other in series. That is, the first coil 51 is wound to have a first pitch interval, and is connected to the drawing line 54. Furthermore, the second coil 52 is wound between the first coil 51 and the power feeding line 53 to have a second pitch interval that is larger than the first pitch interval. Furthermore, the central axes of the first and second coils 51 and 52 are arranged on the same line in series, and the first and second coils 51 and 52 are formed in a rectangular parallelepiped shape, not in a cylindrical shape.

The radiation part 50 can obtain two or more desired resonant frequency bands by appropriately controlling the pitch interval, number of windings and total length of each of the first and second coils 51 and 52. The radiation part 50 of FIG. 5 is constructed in such a way that the pitch interval of the first coil 51 located in the upper portion of the radiation part 50 is small and the pitch interval of the second coil 52 located in the lower portion of the radiation part 50 is large. In this case, considerably large impedance can be obtained in a certain high-frequency band, for example, a first frequency band (1.575 GHz=GPS band), by appropriately controlling the pitch interval of the first upper coil 51. Accordingly, in the high-frequency band, current does not flow in the first coil 51 and the second lower coil 52 having a large pitch interval acts as an antenna.

In contrast, in a certain low-frequency band, for example, a second frequency band (800 to 900 MHz=CDMA band), the impedance of the first coil 51 is not large, so that all the first and second coils 51 and 52 act as an antenna.

Accordingly, in the radiation part 50, two desired resonant frequency bands, such as a Global Positioning System (GPS) band, a Code Division Multiple Access (CDMA) band, a Digital Cellular System (DCS) band and a Geostationary Meteorological Satellite (GSM) band, can be obtained by appropriately designing the pitch interval, number of windings and length of each of the first and second coils 51 and 52.

Furthermore, the first and second coils 51 and 52 of the radiation part 50 are wound in a rectangular parallelepiped shape, so that the radiation part 50 can be mounted in the casing of a mobile communication terminal or on a circuit board like a chip, so that it is appropriate for an internal type.

The radiation part 50 may be formed in such a way that the first and second coils 51 and 52 are wound around a rectangular shaped nonconductive base, or in such a way that coils are wound to have pitch intervals and the coils are formed in a rectangular parallelepiped shape having a desired length*width*height by applying predetermined pressure in vertical and horizontal directions.

In the case of the radiation part 50, a resonant frequency is determined by the total length of coils and a capacitance value varies by the pitch interval of each of the coils, so that the reduction in a bandwidth characteristic caused by miniaturization can be overcome by appropriately controlling the pitch intervals of the first and second coils 51 and 52.

Figure 6A:
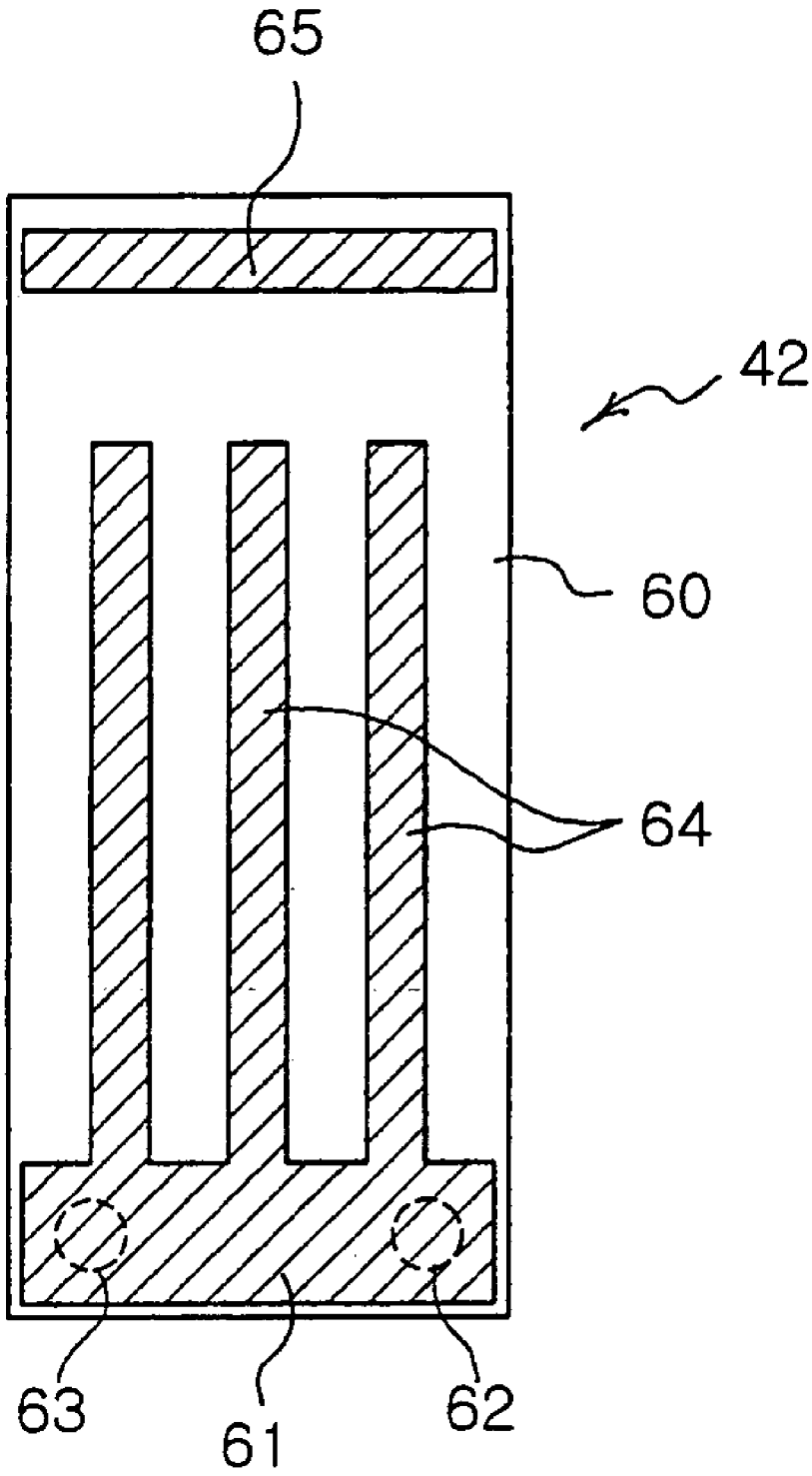
FIGS. 6*a* and 6*b* are views showing the detailed construction of the second radiator according to the embodiment of the present invention.
Figure 6B:
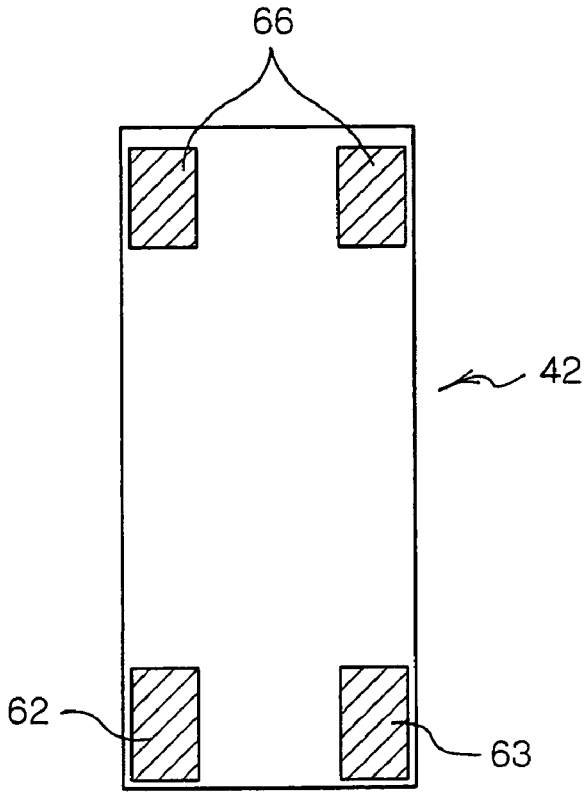

FIGS. 6*a* and 6*b* are views showing the detailed construction of the second radiator according to the embodiment of the present invention.

FIG. 6*a* is a top view showing the second radiator according to the embodiment of the present invention. Referring the FIG. 6*a*, the second radiator 42 according to the embodiment of the present invention includes a connection part 61 formed on a base 60, at least one strip line 64, and an attachment pad 65.

The connection part 61 is formed on the top surface of the base 60, and the first radiator 41 is connected thereto. One end of the first radiator 41 is attached to the connection part 61. Furthermore, a power feeding part 62 for supplying current to the antenna 40 and a ground part 63 for grounding the antenna 40 are formed in the connection part 61. The power feeding part 62 and the ground part 63 are extended to the bottom surface while penetrating the base 60 through via holes. The power feeding line 53 of the first radiator 41 is connected to the power feeding part 62, thus allowing current supplied to the power feeding part 62 to flow through the first and second radiators 41 and 42.

The strip lines 64 are formed of thin and long conductors, and the first ends thereof are connected to the connection part 61. The strip lines 64 are formed on the base 60, and are arranged parallel to the longitudinal direction of the first radiator 41. Although three strip lines are illustrated in FIGS. 6*a* and 6*b*, the number of the strip lines can vary according to desired antenna band characteristics. Furthermore, the resonant frequency and bandwidth of the antenna 40 according to the present invention can be controlled by controlling the lengths of the strip lines 64.

The attachment pad 65 is formed on the top surface of the base 60, and the drawing line 54 of the first radiator 41 is connected to the attachment pad 65. Accordingly, the first radiator 41 is arranged parallel to the second radiator 42, and the first and second radiators 41 and 42 are fixed to maintain a regular radiation pattern.

FIG. 6*b* is a bottom view of the second radiator 42 according to the embodiment of the present invention. Referring to FIG. 6*b*, it can be understood that the power feeding part 62 and the ground part 63 formed on the top surface of the second radiator 42 are formed to be extended to the bottom surface while penetrating the base 60. The power feeding part 62 is connected to the power feeding circuit of a mobile terminal, on which the antenna 40 is mounted, to supply current. Furthermore, the ground part 63 is connected to a ground formed on the mobile terminal to ground the antenna 40. Furthermore, supports 66 for allowing the antenna 40 to be stably mounted in the mobile terminal are formed on the bottom surface of the base 60.

The base 60 can be formed of a Printed Circuit Board (PCB), or be made of a ceramic based on a Low Temperature Co-fired Ceramics (LTCC) process. Accordingly, the connection part 61, the strip lines 64 and the attachment pad 65 may be formed by a LTCC process as well as a PCB process. Furthermore, the antenna 40 can be conveniently mounted in the mobile communication terminal using a fastening method based on Surface Mounting Technology (SMT).

Figure 7:
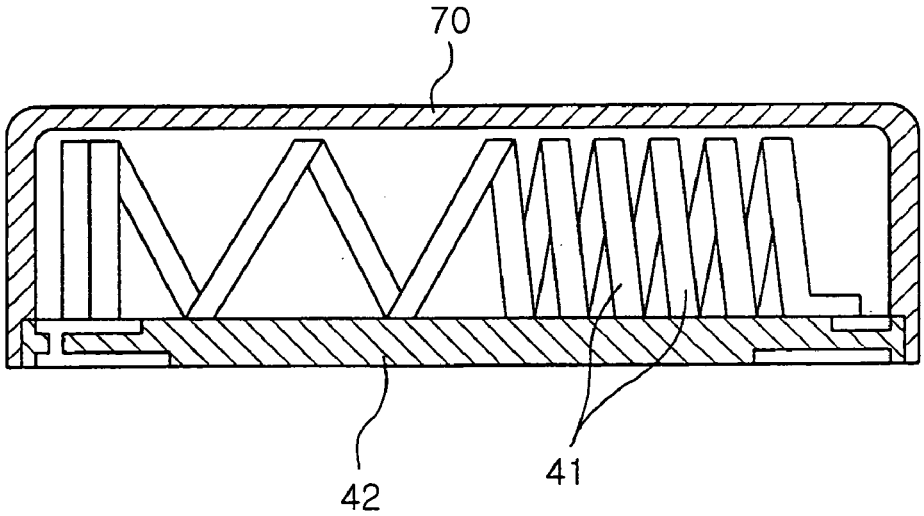
FIG. 7 is a view showing a broadband internal antenna mounted in a casing according to an embodiment of the present invention.

FIG. 7 is a view showing a broadband internal antenna mounted in a casing according to an embodiment of the present invention.

Referring to FIG. 7, the present invention may further include a casing surrounding the antenna 40. The casing 70 is preferably manufactured using a dielectric having an electric constant between 2 and 3. A frequency variation of about 100 MHz occurs in the antenna 40 according to whether the casing 70 exists or not. Accordingly, the casing 70 reduces the size of the antenna 40 by reducing the wavelength of a working frequency.

Figure 8:
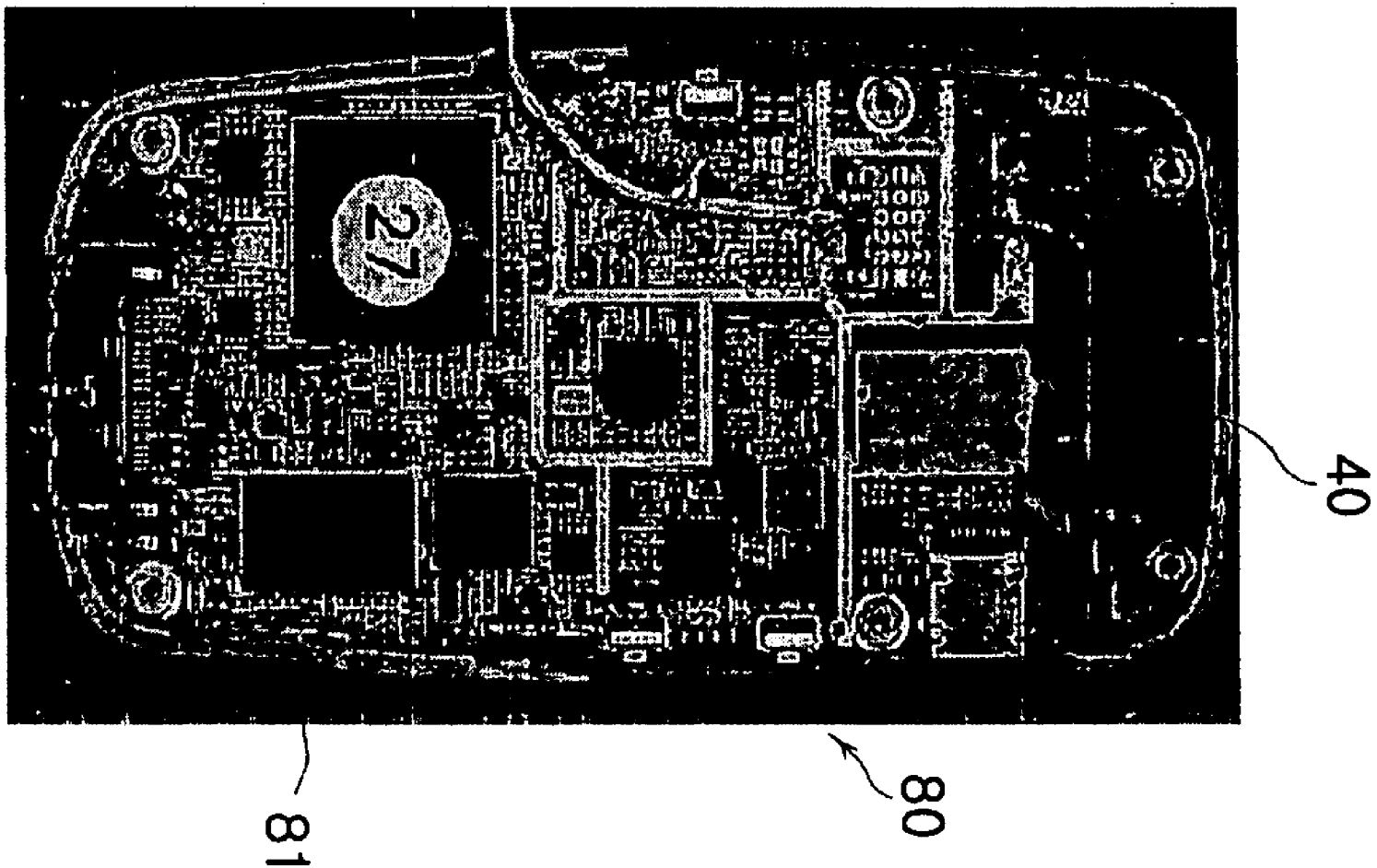
FIG. 8 is a view showing the location of an antenna mounted in a mobile communication terminal according to an embodiment of the present invention.

FIG. 8 is a view showing the mounting location of the antenna in the mobile communication terminal according to an embodiment of the present invention.

Referring to FIG. 8, the antenna 40 according to the embodiment of the present invention may be mounted on the PCB 81 of the mobile communication terminal 80, and be attached to the upper end of the PCB 81 as shown in FIG. 8. That is, the antenna according to the present invention can be formed in a rectangular parallelepiped shape in which the length, width and height thereof are 16, 7 and 5 mm, respectively. The antenna 40 of the present invention is considerably reduced compared to a conventional Microstrip Planar Antenna (MPA) having a 30*20*6 mm size. As shown in FIG. 8, the antenna 40 according to the present invention occupies a small space in the mobile terminal, thus miniaturizing the mobile terminal and providing greater design freedom.

Figure 9:
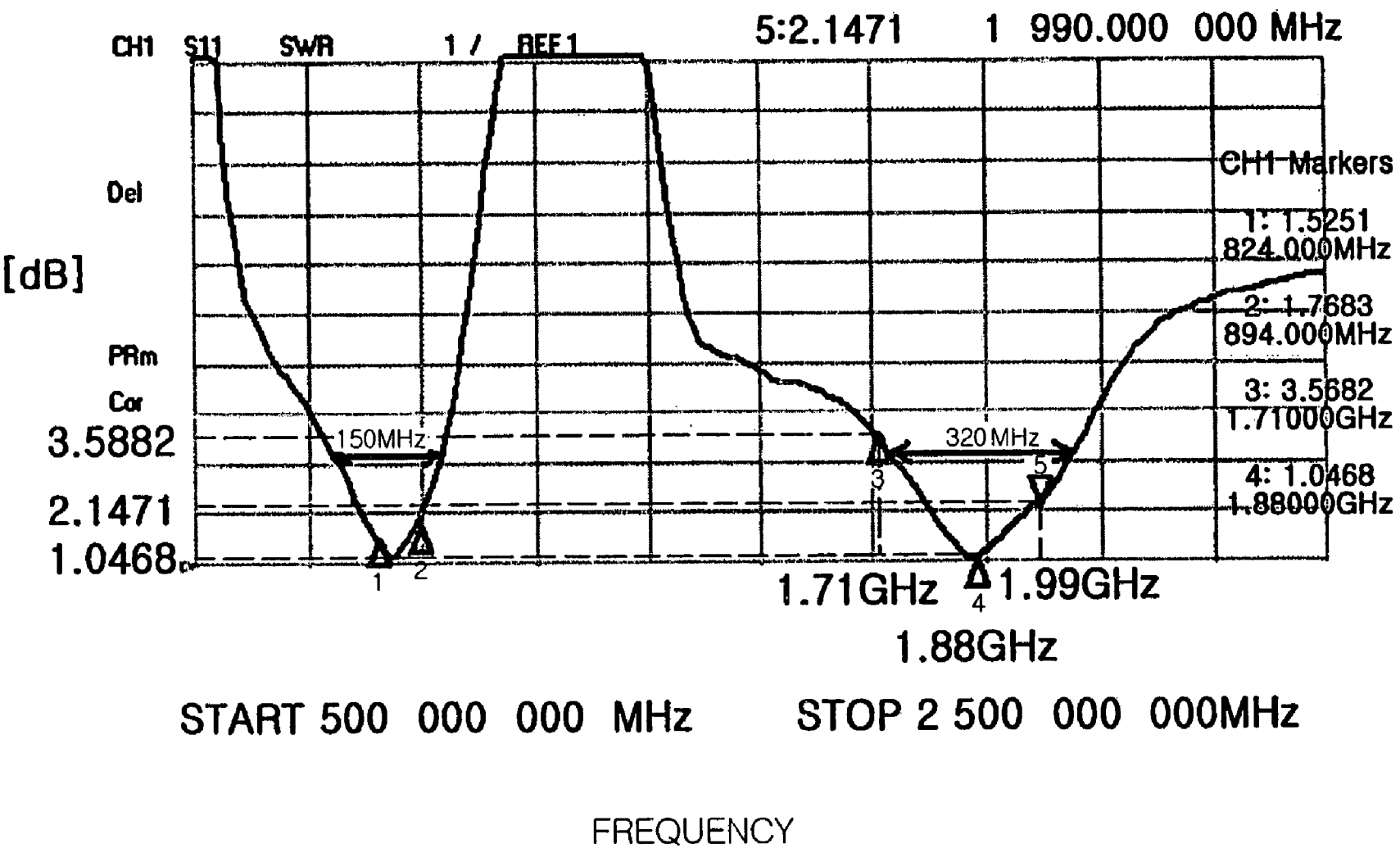
FIG. 9 is a chart showing the Voltage Standing Wave Ratio (VSWR) characteristics of the first radiator according to an embodiment of the present invention.

FIG. 9 is a chart showing the VSWR characteristics of the first radiator according to an embodiment of the present invention.

In the chart of FIG. 9, a vertical axis represents a VSWR, in which the lowest value is one and increases by one in a vertical direction. Furthermore, a horizontal axis represents a frequency. The frequencies and the VSWRs measured at points indicated by "Δ" are represented on a right side and an upper end, respectively.

Referring to FIG. 9, it can be understood that the first radiator 41 according to the present invention secures a bandwidth of about 17% (150 MHz) in a low-frequency band of 800 MHz due to the first and second coils 51 and 52, and a bandwidth of about 16% (320 MHz) in a high-frequency band of 1800 MHz due to the second coil 52.

Figure 10:
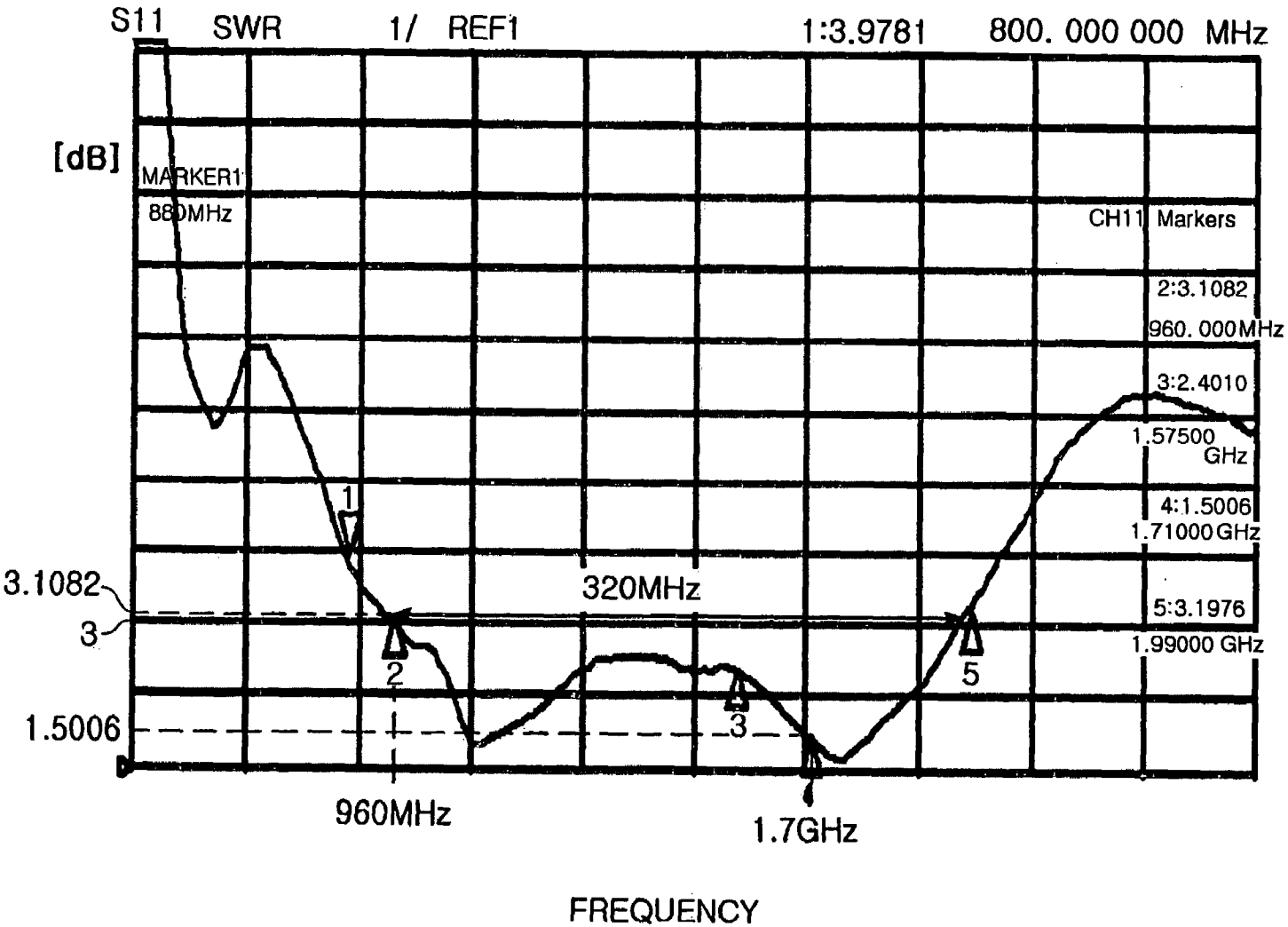
FIG. 10 is a chart showing the VSWR characteristics of the broadband internal antenna according to an embodiment of the present invention.

FIG. 10 is a chart showing the VSWR characteristics of the broadband internal antenna according to an embodiment of the present invention.

The chart of FIG. 10 shows VSWRs of the broadband internal antenna 40 in which the first and second radiators 41 and 42 are connected according to the embodiment of the present invention. Referring to FIG. 10, it can be understood that the broadband internal antenna 40 according to the embodiment of the present invention can secure a wide bandwidth of about 35% (500 MHz) using the EM coupling between the first and second coils 51 and 52 of the first radiator 41 and the strip lines 64 of the second radiator 42.

Figure 11A:
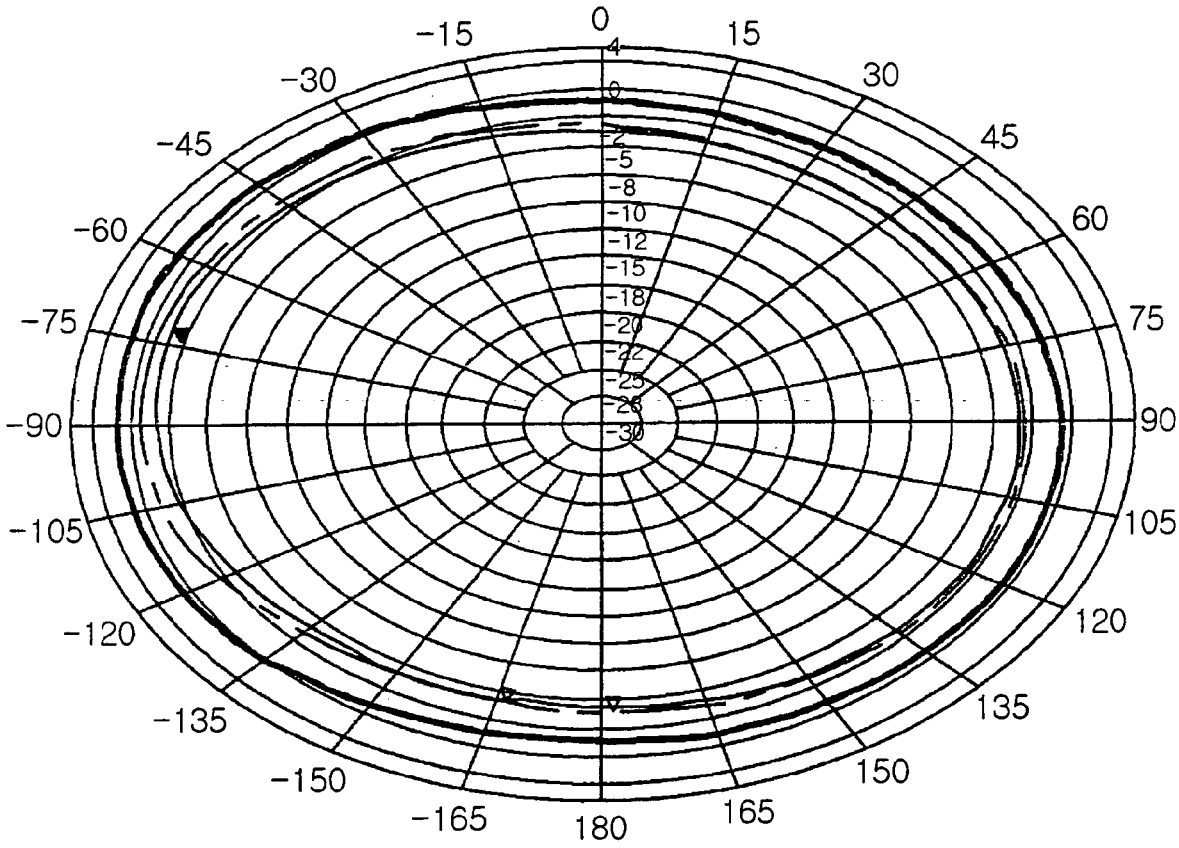
FIGS. 11*a* to 11*i* are views showing the radiation patterns of other broadband internal antenna according to embodiments of the present invention.
Figure 11B:
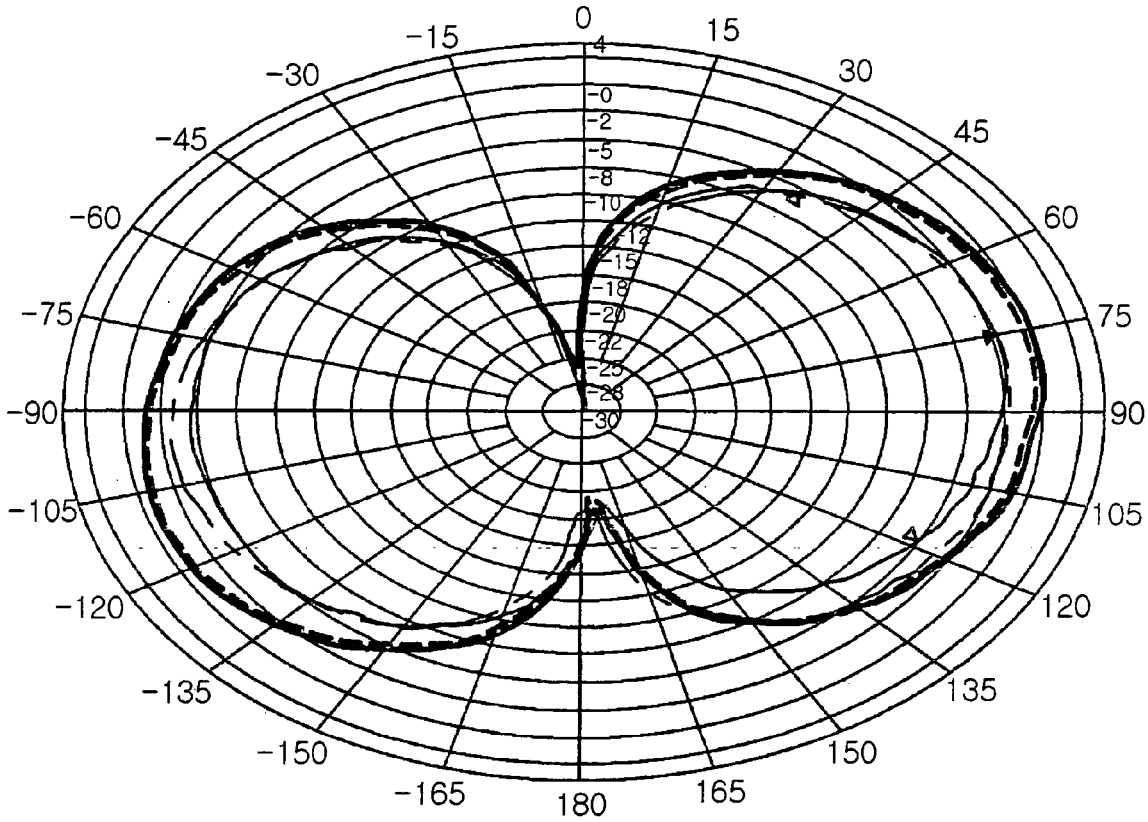
Figure 11C:
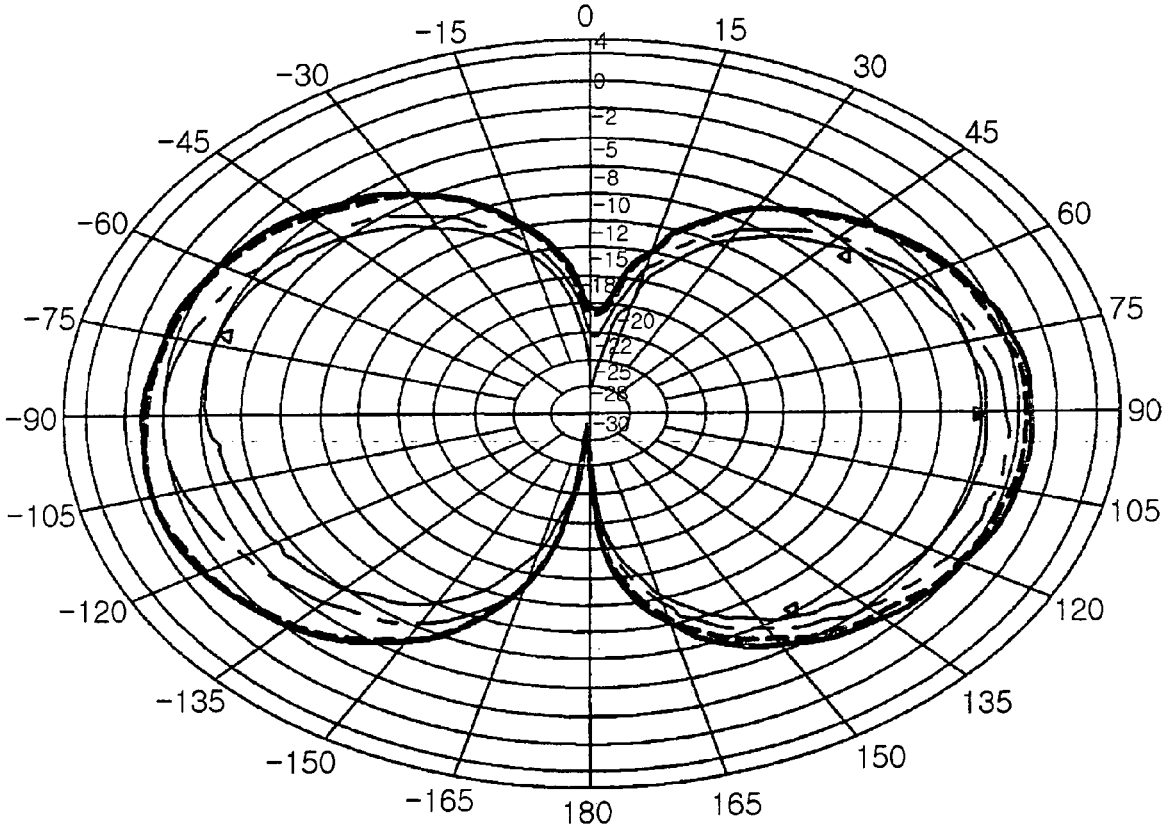
Figure 11D:
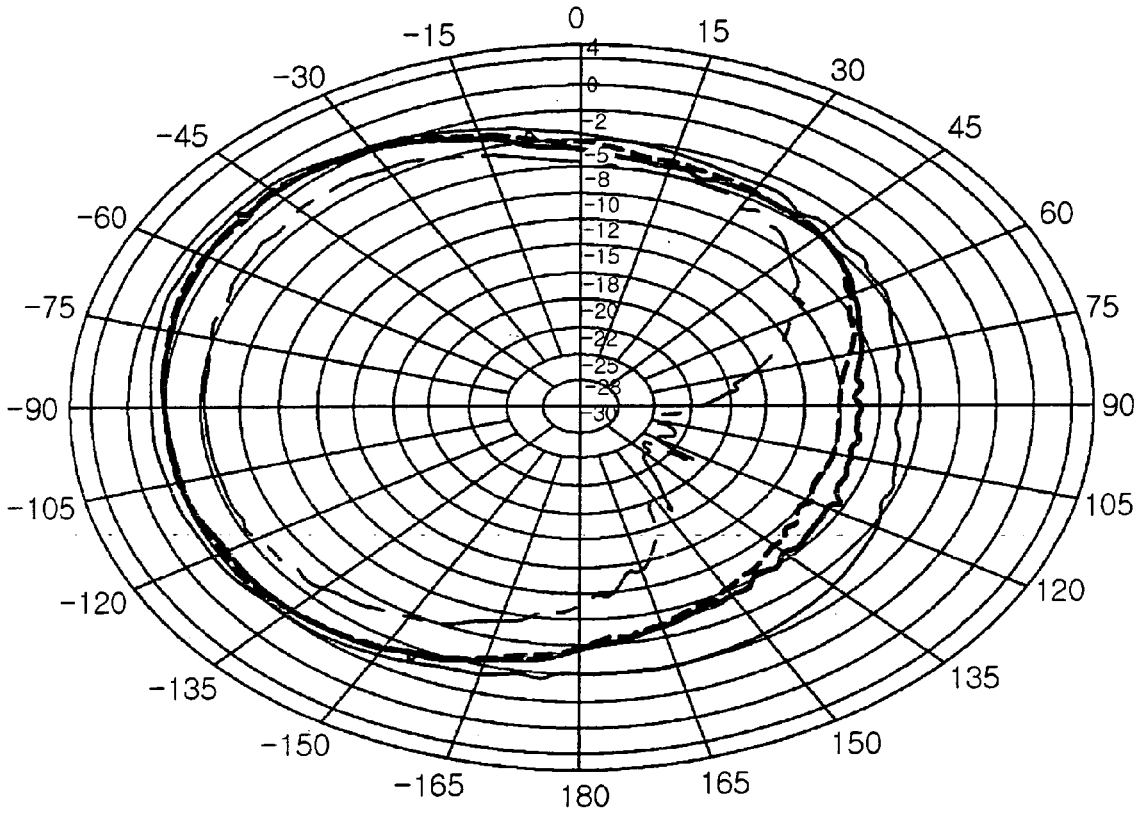
Figure 11E:
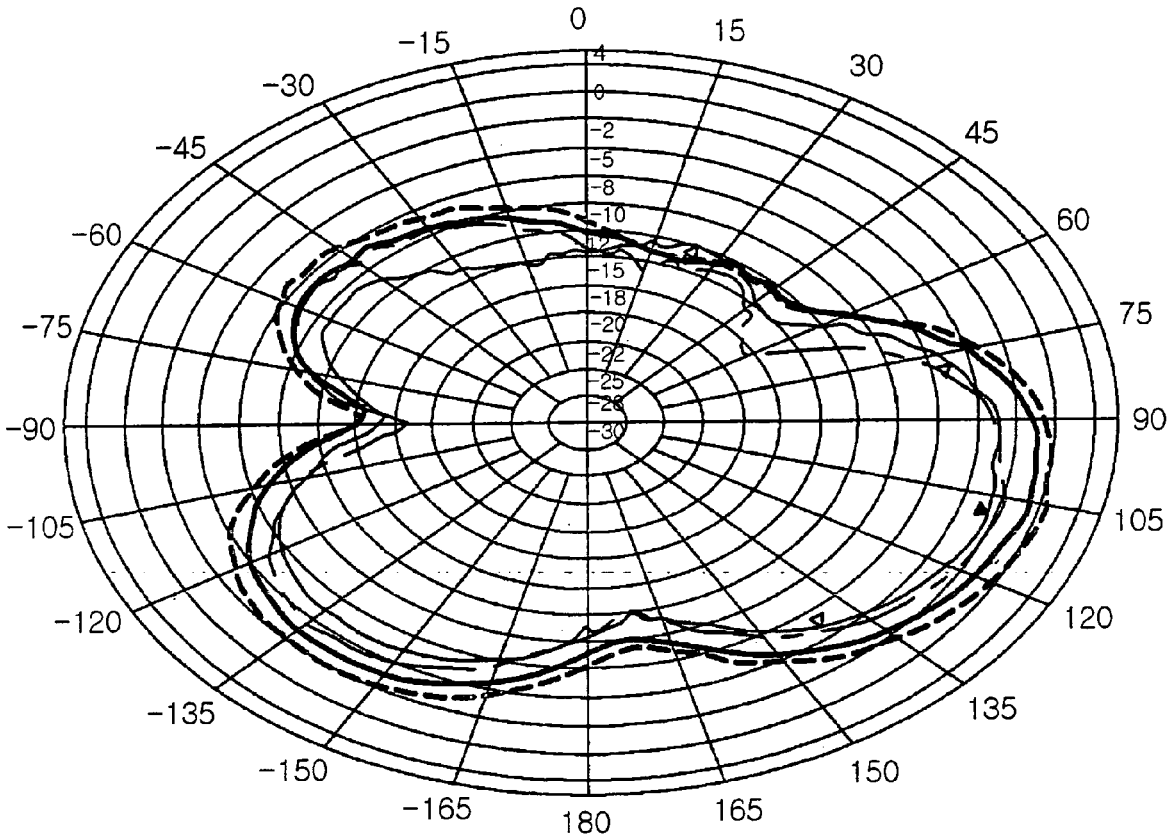
Figure 11F:
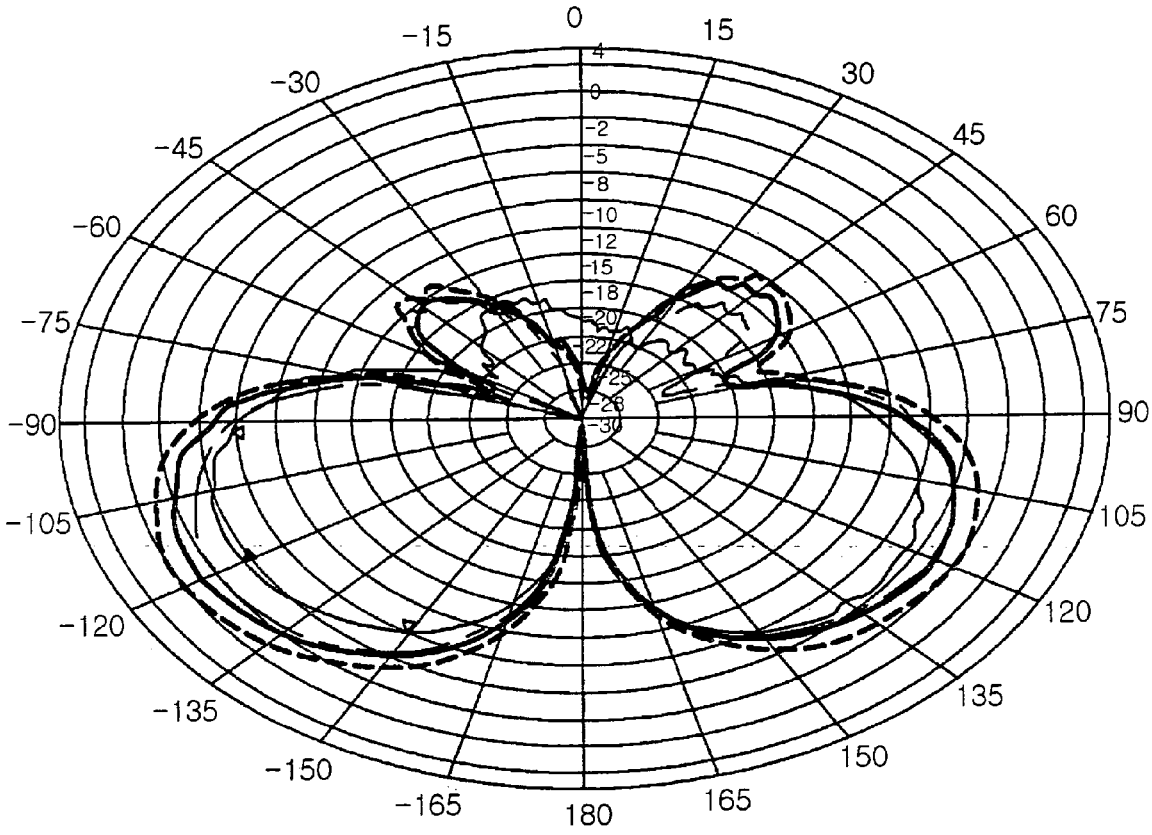
Figure 11G:
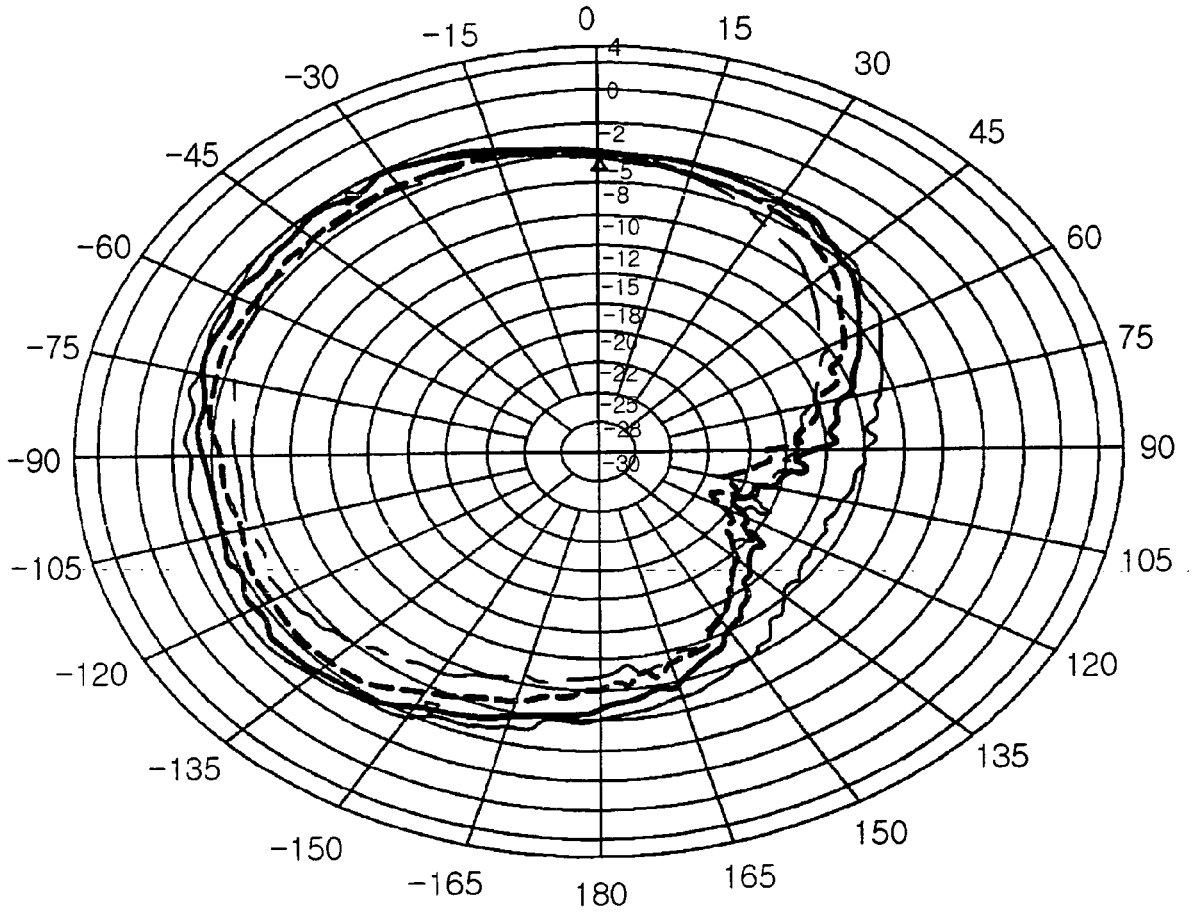
Figure 11H:
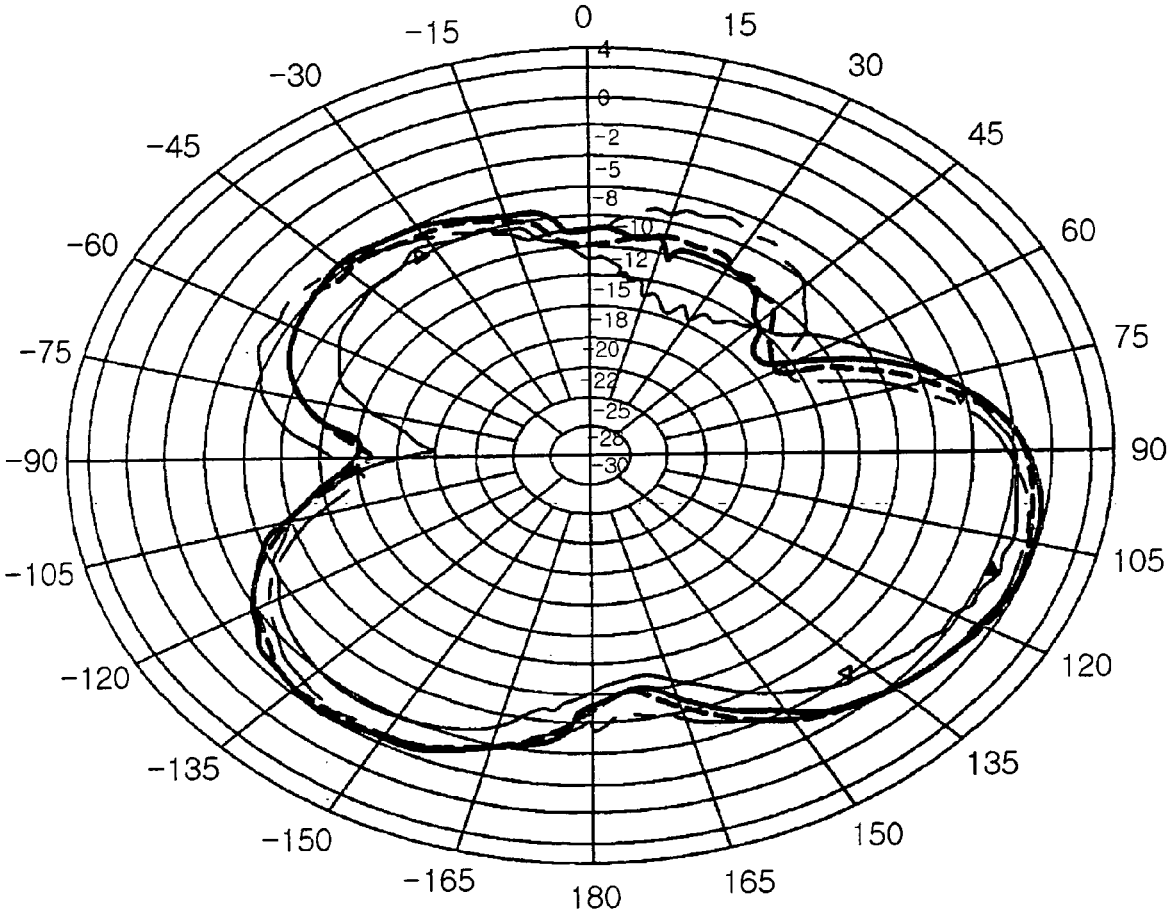
Figure 11I:
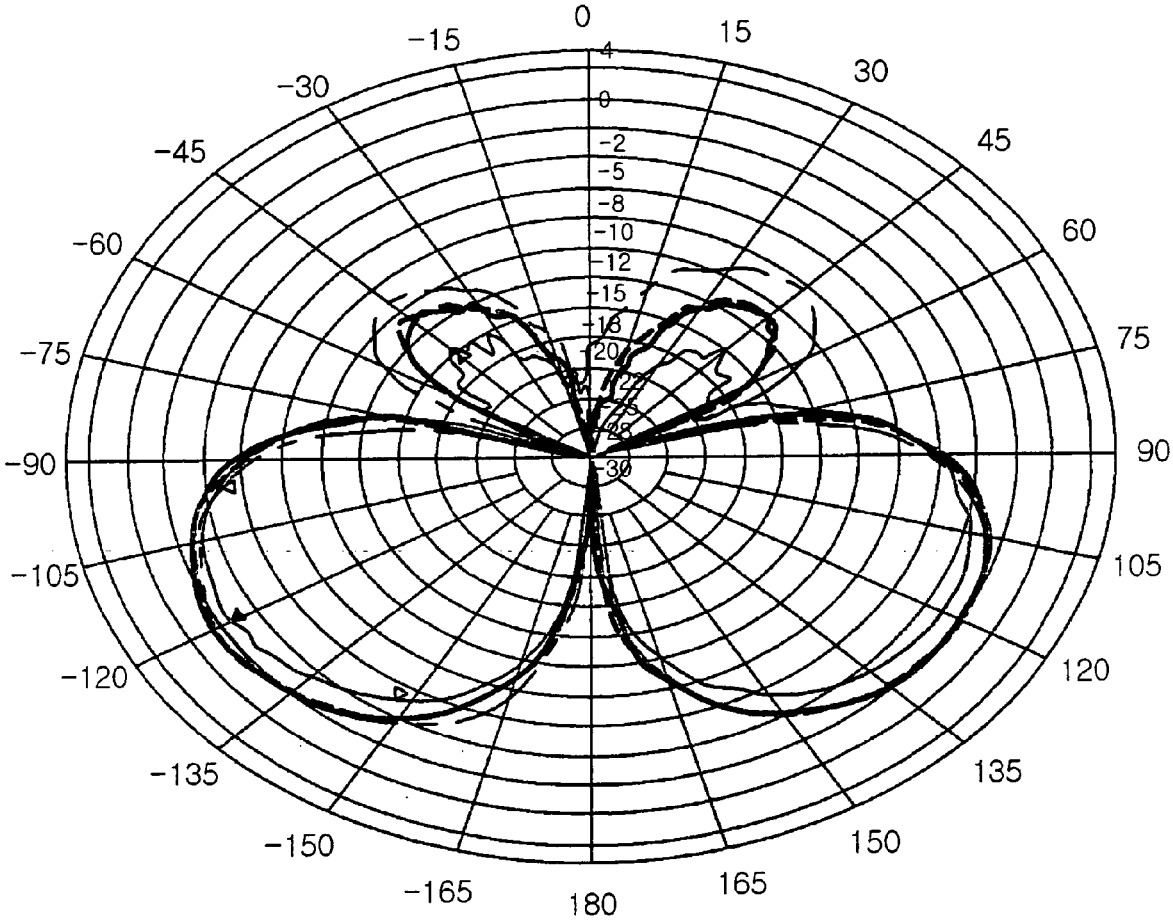

FIGS. 11 to 11*i* are views showing the radiation patterns of other broadband internal antennas according to embodiments of the present invention.

FIGS. 11 to 11*c* show the measurement results of the vertical radiation patterns and horizontal radiation patterns of the broadband internal antenna in a GSM band in a free space. FIGS. 11*d* to 11*f* show the measurement results of the vertical radiation patterns and horizontal radiation patterns of the broadband internal antenna in a DCS band in a free space. FIGS. 11*g* to 11*i* show the measurement results of the vertical radiation patterns and horizontal radiation patterns of the broadband internal antenna in a PCS band in a free space. It can be understood from FIGS. 11*a* to 11*i* that, in the case of the broadband internal antenna of the present invention, regular radiation characteristics are exhibited in all directions around the antenna in the GSM, DCS and PCS bands, and the radiation characteristics are excellent in forward and backward directions. From the above-described result, it can be understood that the broadband internal antenna of the present invention exhibits sufficient antenna characteristics compared to the conventional PIFA and ceramic chip antennas.

According to the present invention as described above, an internal antenna mounted in a mobile terminal can be manufactured to have a small size as well as excellent broadband characteristics. Accordingly, in the case of adopting the broadband internal antenna according to the present invention, the miniaturization and design freedom of the mobile terminal can be achieved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A broadband internal antenna, comprising:

a first radiator having a radiation part in which one or more coils having different pitch intervals are connected in series to each other; and a second radiator having at least one conductive strip line arranged parallel to a longitudinal direction of the first radiator, a connection part to which an end of the at least one conductive strip line is connected, to which a first end of the first radiator is attached and in which a power feeding part for supplying current to the antenna and a ground part for grounding the antenna are formed, and an attachment pad to which a second end of the first radiator is attached and from which current is drawn;

wherein current flowing through the first radiator and current flowing through the strip lines form current paths in different directions, thus setting a certain broadband using mutual Electromagnetic (EM) coupling.

2. The broadband internal antenna as set forth in claim 1, wherein the first radiator is wound substantially in a rectangular parallelepiped shape.

3. The broadband internal antenna as set forth in claim 1, wherein the first radiator comprises a first coil wound in a rectangular parallelepiped shape to have a certain pitch interval and a second coil having a pitch interval larger than that of the first coil, whereby a first pass band is set using an entire length of the first and second coils and a second pass band is set using the second coil.

4. The broadband internal antenna as set forth in claim 1, wherein the first end of the first radiator is connected to a power feeding line for supplying current, and the power feeding line is attached to the power feeding part.

5. The broadband internal antenna as set forth in claim 1, wherein a second end of the first radiator is connected to a drawing line from which current is drawn, and the drawing line is attached to the second radiator by connecting to an attachment pad that is formed on the second radiator.

6. The broadband internal antenna as set forth in claim 1, wherein a resonant frequency and a bandwidth of the antenna can be controlled by changing lengths of the at least one conductive strip line.

7. The broadband internal antenna as set forth in claim 1, wherein the second radiator is formed of a Printed Circuit Board (PCB).

8. The broadband internal antenna as set forth in claim 1, wherein the second radiator is formed by a Low Temperature Co-fired Ceramics (LTCC) process.

9. The broadband internal antenna as set forth in claim 1, wherein the pitch interval, number of windings, and total length of the coils of the radiation part are controlled to obtain two or more desired resonant frequency bands.

10. The broadband internal antenna as set forth in claim 1, further comprising a casing made of a dielectric to surround the first radiator.

11. The broadband internal antenna as set forth in claim 10, wherein the casing is made of a dielectric having a dielectric constant between 2 and 3.

* * * * *